US011090789B2

(12) United States Patent
Kirchberger et al.

(10) Patent No.: US 11,090,789 B2
(45) Date of Patent: Aug. 17, 2021

(54) SLIDING ELEMENT FOR TRANSMITTING A SLIDING FORCE ONTO A SLIDING SLEEVE AND CONNECTING TOOL COMPRISING SAID SLIDING ELEMENT

(71) Applicant: REHAU Construction LLC., Leesburg, VA (US)

(72) Inventors: Andreas Kirchberger, Herzogenaurach (DE); Thomas Schaaf, Höchstadt (DE); Hansi Homburg, Höchstadt (DE); Oliver Vocks, Fürth (DE)

(73) Assignee: REHAU CONSTRUCTION LLC, Leesburg, VA (US)

( * ) Notice: Subject to any disclaimer, the term of this patent is extended or adjusted under 35 U.S.C. 154(b) by 472 days.

(21) Appl. No.: 15/998,751

(22) PCT Filed: Feb. 10, 2017

(86) PCT No.: PCT/EP2017/000193
§ 371 (c)(1),
(2) Date: Aug. 16, 2018

(87) PCT Pub. No.: WO2017/140417
PCT Pub. Date: Aug. 24, 2017

(65) Prior Publication Data

US 2021/0069880 A1 Mar. 11, 2021

(30) Foreign Application Priority Data

Feb. 16, 2016 (DE) ..... 20201611773.9

(51) Int. Cl.
*B25B 27/00* (2006.01)
*B25B 27/10* (2006.01)

(52) U.S. Cl.
CPC ..... *B25B 27/10* (2013.01)

(58) Field of Classification Search
CPC ..... B23P 19/00; B23P 19/027; B23P 19/04; B23P 19/061; B23P 19/10
See application file for complete search history.

(56) References Cited

U.S. PATENT DOCUMENTS 5,398,394 A * 3/1995 Hyatt ..... B21D 39/04 29/237
5,592,726 A * 1/1997 Suresh ..... B21D 39/04 29/237

(Continued)

FOREIGN PATENT DOCUMENTS

DE 10 2004 018429 A1 10/2005
DE 20 2010 013813 U1 1/2012

(Continued)

OTHER PUBLICATIONS

International Search Report for PCT/EP2017/000193, dated May 9, 2017; English Translation submitted herewith (5 pages).

*Primary Examiner* — Lee D Wilson
(74) *Attorney, Agent, or Firm* — Fitch, Even, Tabin & Flannery, LLP

(57) ABSTRACT

A sliding element for transmitting a sliding force onto a sliding sleeve which is provided to be slid, at least in sections, onto a widened end region of a tube has at least one stop surface with a recess, wherein the stop surface is designed for arranging the sliding sleeve on the stop surface and the recess is designed for the arrangement of a portion of the tube. The stop surface has an edge facing away from the recess and an edge facing the recess. The stop surface comprises at least two raised regions which are arranged spaced apart from that edge of the stop surface which faces away from the recess, and/or the stop surface comprises two extension portions which extend the stop surface on both sides of the recess beyond the end of a respective limb.

24 Claims, 2 Drawing Sheets

(56) References Cited

U.S. PATENT DOCUMENTS

Figure 1:
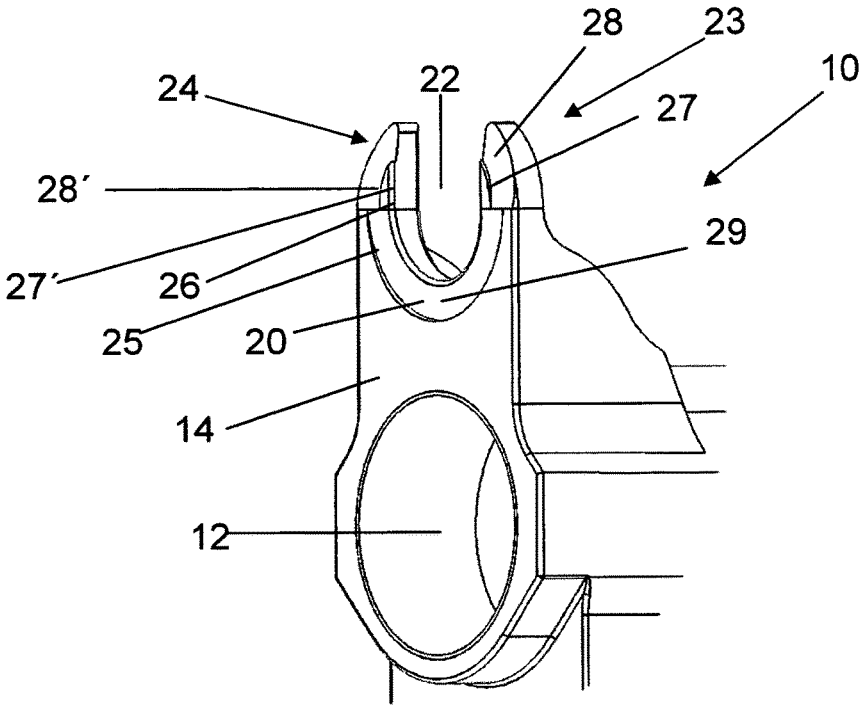

| | | | | |
|---|---|---|---|---|
| 2003/0167614 | A1* | 9/2003 | Morrison | B25B 27/10 29/237 |
| 2021/0069880 | A1* | 3/2021 | Kirchberger | B25B 27/10 |

FOREIGN PATENT DOCUMENTS

| | | | |
|---|---|---|---|
| JP | H08-326974 | A | 12/1996 |
| WO | 96/09916 | A2 | 4/1996 |

* cited by examiner

SLIDING ELEMENT FOR TRANSMITTING A SLIDING FORCE ONTO A SLIDING SLEEVE AND CONNECTING TOOL COMPRISING SAID SLIDING ELEMENT

CROSS-REFERENCE TO RELATED APPLICATIONS

This application is a U.S. national phase application filed under 35 U.S.C. § 371 of International Application No. PCT/EP2017/000193, filed Feb. 10, 2017, designating the United States, which claims priority from German Patent Application No. 202016100773.9 filed Feb. 16, 2016, which are hereby incorporated herein by reference in their entirety.

The present invention relates to a sliding element for transmitting a sliding force onto a sliding sleeve which is provided to be slid, at least in sections, onto a widened end region of a tube, wherein the sliding element has at least one stop surface with a recess, wherein the stop surface is designed for arranging the sliding sleeve on the stop surface and the recess is designed for the arrangement of a portion of the tube, wherein the stop surface has an edge facing away from the recess and an edge facing the recess. Furthermore, the present invention relates to a connecting tool which comprises a sliding element of this type.

Sliding elements, such as, for example, known pressing yokes, are used in particular if an axial press connection is to be produced between a tube connection element or a fitting and a tube, wherein; in order to produce said connection, generally two sliding elements which are arranged on the tube are moved toward each other by means of a tool in order to slide a sliding sleeve onto a previously widened end portion of the tube. In this case, one of the two sliding elements lies with its stop surface against an end side of the sliding sleeve, and the other sliding element lies with its stop surface generally against a fitting collar of the fitting or of the tube connection element. By means of an oppositely directed movement of the two sliding elements toward each other, an axial press connection can then be produced, in which the connecting portion of the fitting is slid into the widened end portion of the tube and the sliding sleeve is slid onto the widened end portion of the tube. For example, DE 10 2004 018 429 A1 describes a device for applying an axial pressing force with a housing which has receptacles for two sliding elements. The sliding elements each have a recess for the arrangement of a tube portion or a tube connection element.

A disadvantage of sliding elements of this type is considered the fact that, in the finished tube connection, in particular when plastics sliding sleeves are used, because of the high action of force during the pressing operation said sliding elements leave behind deformations or impressions on the end surface of the sliding sleeve, against which the sliding element lies during the transmission of force, said deformations or impressions being clearly visible to the outside and having a negative effect on the perceived value of the tube connection. These impressions of the sliding elements are particularly clearly visible in the case of plastics sliding sleeves which have a colored plastics layer on their outer side. There is the risk here that kinks, tears and bulges may occur in the colored plastics layer.

Accordingly, the object of the present invention is to provide sliding elements for transmitting a sliding force onto a sliding sleeve and a corresponding connecting tool, which overcome the disadvantages of the prior art. In particular, the sliding element according to the invention is intended to lead to a significant reduction in the visibility of deformations, caused by the pressing operation, on the end surface of the sliding sleeve. In particular, the occurrence of kinks, tears, bulges and other deformations in the colored plastics layer in the case of sliding sleeves with a colored outer side is intended to be avoided.

This object and further objects are achieved according to the invention by a sliding element with the features of claim 1 and by a connecting tool with the features of claim 13. Preferred embodiments of the sliding element according to the invention are described in the claims which are dependent thereon.

According to the present invention, it has been recognized that the deformations or impressions caused by the sliding element on the end surface of the sliding sleeve are outwardly less apparent if the force which is transmitted by the sliding element onto the sliding sleeve acts further on that side of the end surface which is located the opening of the sliding sleeve. According to the invention, this takes place by elevated or raised regions being located on those edge regions of the stop surface of the sliding element which face the recess. During the pressing operation, said elevated or raised regions of the stop surface of the sliding element lie against the end surface of the sliding sleeve, and therefore force is likewise transmitted from the sliding element onto the sliding sleeve in this region. Additionally or alternatively thereto, this can also be achieved by the stop surface comprising two extension portions which extend the stop surface on both sides of the recess beyond the end of a respective limb. The deformations or impressions, which are caused by the sliding elements, on the end surface of the sliding sleeve are therefore located more in the direction of that edge of the end surface which is directed toward the opening of the sliding sleeve, and therefore they are outwardly less apparent in the finished tube connection. During use of a sliding sleeve with a colored outer layer, no kinks, tears or bulges occur in the colored plastics layer since force is not transmitted in the region of the outer layer of the sliding sleeve.

Accordingly, the present invention resides in the provision of a sliding element for transmitting a sliding force onto a sliding sleeve which is provided to be slid, at least in sections, onto a widened end region of a tube, wherein the sliding element has at least one stop surface with a recess, wherein the stop surface is designed for arranging the sliding sleeve on the stop surface, and the recess is designed for the arrangement of a portion of the tube, wherein the stop surface has an edge facing away from the recess and an edge facing the recess, wherein the stop surface comprises at least two raised regions which are arranged spaced apart from that edge of the stop surface which faces away from the recess, and/or the stop surface comprises two extension portions which extend the stop surface on both sides of the recess beyond the end of a respective limb. Furthermore, the present invention resides in the provision of a connecting tool for producing a connection between a tube connection element and a widened end portion of a tube, wherein, in the connection, a sliding sleeve is slid onto the widened end portion, and at least one end portion of the tube connection element is slid into the widened end portion of the tube, wherein the connecting tool comprises at least one sliding element according to the invention.

With regard to the sliding element according to the invention, it is preferred if at least one of the raised regions and/or of the extension portions are arranged in a region which is lowered in relation to the base level of the stop surface. A configuration of this type can be produced in a simple manner since the raised regions can be produced by abrading machining, for example by milling off. In this connection, it may be of particular benefit if the raised regions do not project beyond the base level of the stop surface. This leads to material savings for the sliding element. As used herein, the term "base level of the stop surface" stands for a height of the stop surface relative to a front surface of the sliding element, which is adjoined by the raised regions of the stop surface. It is particularly preferred here if the raised regions do not project beyond a front surface of the sliding element, in particular do not project beyond the base level of the stop surface. It is of particular benefit here if the lowered regions are designed as bevels. It is very particularly preferred if the lowered regions adjoin the base level of the stop surface in a step-free manner. This avoids formation of edges at the impressions on the end side of the sliding sleeves.

It can be preferred if the stop surface has an at least approximately semicircular portion. It is favorable here if two of the raised regions and/or of the extension portions adjoin the semicircular portion of the stop surface. This brings about a symmetrical transmission of force from the sliding element according to the invention to the sliding sleeve which is to be slid onto the widened tube end. It is preferred here if the semicircular portion of the stop surface is inclined relative to the front surface of the sliding element. Tilting of the sliding sleeve during the pressing operation is thereby intended to be prevented.

It may also be of benefit if an elevation is formed on the stop surface at the same distance from the two raised regions and/or the extension portions. Alternatively, it is also possible to distribute a plurality of elevations on the stop surface in order, during the displacement of the sleeve, to thus distribute the force substantially over that region of its end surface which faces the inner diameter. A symmetrical distribution of the elevations is preferred here since this contributes to preventing tilting of the sliding sleeve during the pressing operation.

The raised regions and/or the extension portions and/or the elevation(s) are preferably designed independently of one another in a tapering manner. Alternatively or additionally thereto, the individual raised regions and/or the extension portions and/or the elevation can independently of one another be of cam-shaped, spherical section-shaped, conical, pyramid-shaped or cylindrical design or can have any other desired shape.

It may also be helpful if the raised regions and/or the extension portions do not project beyond that edge of the stop surface which faces the recess. Damage to the tube outer surface is thereby avoided.

It is preferred that the width of the raised regions and/or of the extension portions and/or of the elevation(s) is smaller than the wall thickness of the sliding sleeve.

It may also be preferred if the sliding element according to the invention is has a cylindrical opening with a central longitudinal axis. This ensures simple and rapid installation of the sliding element according to the invention on the connecting tool. It can be of importance that the holding device or the element of the displacement device of the connecting tool according to the invention has an outer surface which is complementary at least in sections to the opening of the sliding element. As a result, in the mounted state, the sliding element lies against the connecting tool such that secure handling of the connecting tool according to the invention is ensured.

Figure 2:
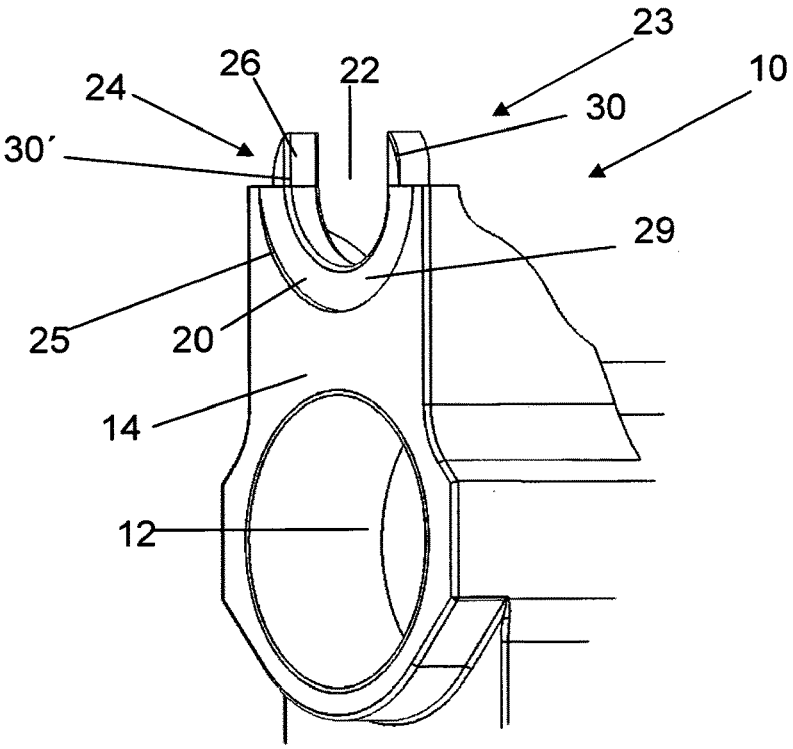
Figure 3:
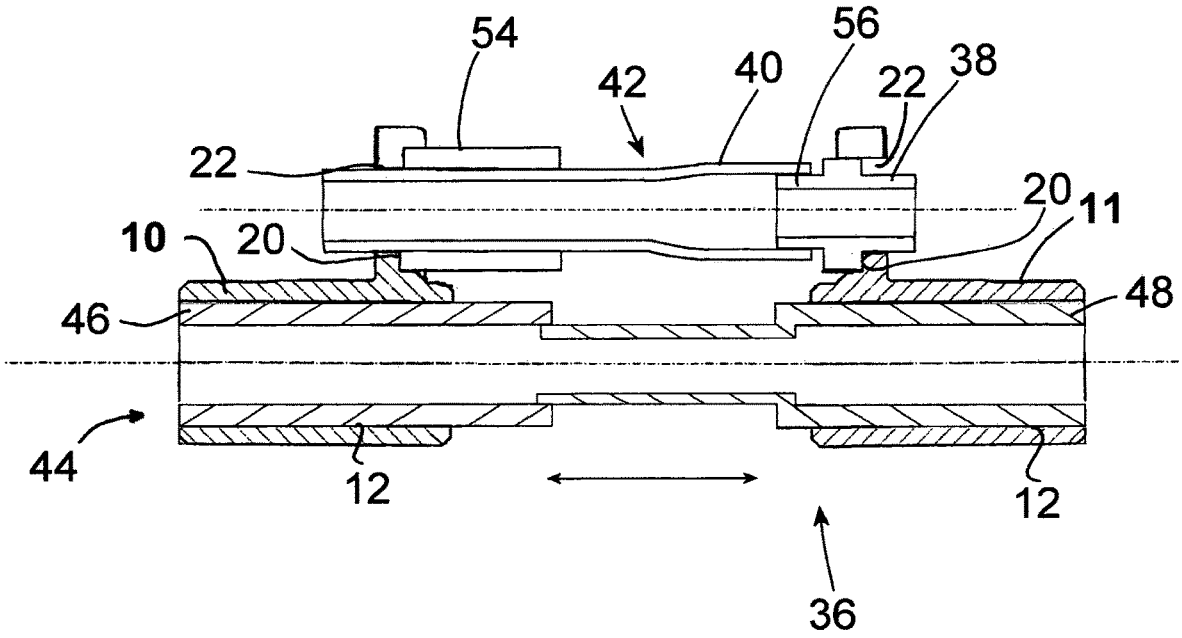

The present invention will be explained in detail below with reference to the embodiments illustrated in the figures, in which FIG. 1 shows a perspective partial view of a sliding element according to an embodiment of the present invention;

FIG. 2 shows a perspective partial view of a sliding element according to a further embodiment of the present invention; and FIG. 3 shows a schematic sectional view of an exemplary embodiment of a displacement tool according to the invention.

FIG. 1 shows a perspective partial view of a sliding element 10 according to an embodiment of the present invention. The sliding element 10 according to the invention is produced from a metal block, in particular a steel block, preferably by metal-cutting machining. On its front side, the sliding element 10 according to the invention has a circular-cylindrical opening 12 with a central longitudinal axis and a substantially flat front surface 14.

The sliding element 10 according to the invention serves for transmitting a sliding force onto a sliding sleeve 54 which is provided to be slid, at least in sections, onto a widened end region 40 of a tube 42 (FIG. 3). For this purpose, the sliding element 10 according to the invention comprises at least one stop surface 20 which serves for arranging an end surface of the sliding sleeve 54 on the stop surface 20. The stop surface has a recess 22, and therefore a yoke-like arrangement with two limbs 23, 24 results. A portion of the tube 42, onto the widened end 40 of which the sliding sleeve 54 is intended to be slid, can be guided through the recess 22. Furthermore, the stop surface 20 has an edge 25 facing away from the recess 22 and an edge 26 facing the recess 22.

Between the two edges 25, 26, two raised regions 27, 27' are arranged on the stop surface 20 in the embodiment illustrated in FIG. 1. The raised regions 27 is arranged here on the limb 23 while the raised regions 27' is arranged on the limb 24. The raised regions 27, 27' do not protrude here beyond the edge 26 facing the recess 22, i.e. do not project into the recess 22. As a result, damage to the outer surface of the tube 42 by the production of the tube connection is avoided. The raised regions 27, 27' are arranged spaced apart from that edge 25 of the stop surface 20 which faces away from the recess 22. The width of the raised regions 27, 27' is in each case selected here in such a manner that it is smaller than the wall thickness of the sliding sleeve 54, which wall thickness also forms the end surface of said sliding sleeve.

During the transmission of sliding force by the sliding element 10 according to the invention onto the sliding sleeve 54, i.e. during the pressing operation, the end surface of the sliding sleeve 54 lies against the stop surface 20 of the sliding element 10 according to the invention. The raised regions 27, 27' are pressed here into the end surface of the sliding sleeve 54, and therefore said regions can leave behind deformations or impressions in the end surface of the sliding sleeve 54. By means of the described arrangement of the raised regions 27, 27', the resulting deformations or impressions are located exclusively in the direction of that edge of the end surface which is directed toward the opening of the sliding sleeve 54. As a result, they can scarcely be seen to the outside in the finished tube connection and do not noticeably reduce the high-quality impression thereof. When a sliding sleeve 54 with a colored outer layer is used, no kinks, tears or bulges occur in said outer layer since force is not transmitted in the region of the outer layer of the sliding sleeve.

In the embodiment, illustrated in FIG. 1, of the sliding element 10 according to the invention, the raised regions 27, 27' are each arranged in a region 28, 28' which is lowered in relation to the base level of the stop surface 20. The lowered regions 28, 28' are designed here as bevels dropping toward the end of the respective limb 23, 24 and adjoin the base level of the stop surface 20 in a step-free manner. The raised regions 27, 27' are flush with the base level of the stop surface 20, i.e. do not project beyond said base level. In alternative embodiments, the raised regions 27, 27' can protrude over the base level of the stop surface 20, in particular can also protrude over the front surface 14 of the sliding element 10 according to the invention. In alternative embodiments, the stop surface 22 does not comprise any lowered regions 28, 28', and therefore the raised regions 27, 27' are designed as excess lengths over the base level of the stop surface 20.

In the embodiment, illustrated in FIG. 1, of the sliding element 10 according to the invention, the stop surface 20 has two raised regions 27, 27'. In alternative embodiments, one or more further elevations can also be present on the stop surface, said elevations, however, likewise being arranged between the two edges 25, 26 of the stop surface 20. The elevations are preferably distributed symmetrically over the stop surface in order to reduce the risk of tilting of the sliding sleeve 54 during the pressing operation.

In the embodiment, illustrated in FIG. 1, of the sliding element 10 according to the invention, the raised regions 27, 27' are each of tapering design. This shape of the raised regions 27, 27' is preferred according to the invention, but is not absolutely necessary. Alternatively, the individual raised regions 27, 27' and optionally present further elevations can independently of one another be of cam-shaped, spherical section-shaped, conical or cylindrical design.

The stop surface 20 preferably has a semicircular portion 29 which is adjoined by the two raised regions 27, 27'. This results in a symmetrical transmission of force from the sliding element 10 according to the invention onto the sliding sleeve 54 which is to be slid onto the widened tube end 42. In the embodiment, illustrated in FIG. 1, of the sliding element 10 according to the invention, the semicircular portion 29 of the stop surface 20 is inclined relative to the front surface 14 of the sliding element 10 according to the invention. This is likewise intended to prevent tilting of the sliding sleeve 54 during the pressing operation.

FIG. 2 shows a perspective partial view of a sliding element 10 according to a further embodiment of the present invention. The sliding element 10 according to the invention according to FIG. 2 differs from the sliding element 10 according to the invention that is illustrated in FIG. 1 merely in that the lowered region 28, 28' of the sliding element 10 according to the invention according to FIG. 1 are completely removed in the sliding element 10 according to the invention according to FIG. 2. This results in two extension portions 30, 30' of the stop surface 20. The extension portions 30, 30' extend the respective limb 23, 24 of the stop surface 20 beyond the respective end of said limb on both sides of the recess 22.

During the transmission of a sliding force by the sliding element 10 according to the invention according to FIG. 2 onto the sliding sleeve 54, the end surface of the sliding sleeve 54 lies against the stop surface 20 of the sliding element 10 according to the invention. The extension portions 30, 30' are pressed here into the end surface of the sliding sleeve 54, and therefore they may leave behind deformations or impressions in the end surface of the sliding sleeve 54. By means of the arrangement of the extension portions 30, 30' which corresponds to that of the raised regions 27, 27' in the sliding element 10 according to the invention according to FIG. 1, the resulting deformations or impressions are located exclusively in the direction of that edge of the end surface which is directed toward the opening of the sliding sleeve 54. As a result, they can scarcely be seen to the outside in the finished tube connection and do not noticeably reduce the high-quality impression thereof. When a sliding sleeve 54 with a colored outer layer is used, no kinks, tears or bulges occur in said outer layer since again no transmission of force takes place in the region of the outer layer of the sliding sleeve.

The sliding element 10 according to the invention has a circular-cylindrical opening 12 with a central longitudinal axis which is provided for receiving a portion of a holding device or of an element of the displacement device 44 of the connecting tool 36 according to the invention. A passage opening (not illustrated in FIG. 1) is formed in the wall, which bounds the cylindrical opening 12 toward the sliding element 10, said passage opening extending continuously into the cylindrical opening 12. The passage opening serves for receiving a connecting means, for example a holding pin, by means of which the sliding element 10 is secured in a positionally fixed manner on a holding device or on an element of the displacement device 44 of the connecting tool 36 according to the invention. The holding device or the element 46, 48 of the displacement device 44 of the connecting tool 36 according to the invention (FIG. 4) has, at least in sections, a circular-cylindrical outer surface which is complementary with respect to the cylindrical opening 12. Furthermore, the holding device or the element of the displacement device 44 of the connecting tool 36 according to the invention has receptacles for fixing means or connecting means, which are in engagement with the passage opening, as a result of which the sliding element 10 can be secured in a positionally fixed manner on the holding device or the element.

A sectional view of an exemplary embodiment of a connecting tool 36 according to the invention for producing a connection between a tube connection element 38 and a widened end portion 40 of a tube 42 is shown in FIG. 2. The connecting tool 36 has a first sliding element 10 according to the invention, a second sliding element 11, which is not necessarily designed according to the present invention, and a displacement device 44 which comprises a first and a second element 46, 48 which are displaceable rectilinearly one in the other, wherein a portion of the first element 46 is accommodated in a positionally fixed manner in the cylindrical opening 12 of the first sliding element 10 according to the invention, and wherein a portion of the second element 48 is accommodated in a positionally fixed manner in the cylindrical opening 12 of the second sliding element 11.

The first sliding element 10 according to the invention is provided to transmit a sliding force onto a sliding sleeve 54, which has been slid onto the tube 42, in order to slide said sliding sleeve onto the widened end portion 40. The second sliding element 11 is provided to transmit a sliding force onto the tube connection element 38 in order to slid an end portion 56 of the tube connection element 38, which end portion is adjacent to a fitting collar 58 of the tube connection element 38, into the widened end portion 40 of the tube 42. Furthermore, a displacement unit (not illustrated specifically) is provided which is coupled to the displacement device 44, wherein the displacement unit is configured to move the two elements 46, 48 toward each other in order to produce the connection.

It becomes clear from FIG. 2 that a tube portion is arranged in the recess 22 of the stop surface 20 of the first sliding element 10 while a portion of the tube connection element 38 is arranged in the recess 22 of the stop surface 20 of the second sliding element 11.

The present invention has been described in detail with reference to the embodiments of the present invention that are shown in the figures. It goes without saying that the present invention is not restricted to the embodiments shown, but rather the scope of the present invention emerges from the appended claims.

The invention claimed is:

1. A sliding element for transmitting a sliding force onto a sliding sleeve which is provided to be slid, at least in sections, onto a widened end region of a tube, the sliding element comprising at least one stop surface with a recess, wherein the stop surface is configured for arranging an end surface of the sliding sleeve on and facing the stop surface, the recess is configured for the arrangement therein of a portion of the tube, the stop surface has a first edge adjacent the recess and a second edge spaced away from the recess, and the stop surface comprises at least two raised regions which are arranged spaced apart from the second edge of the stop surface.

2. The sliding element as claimed in claim 1, wherein at least one of the raised regions is arranged in a region which is lowered in relation to a base level of the stop surface.

3. The sliding element as claimed in claim 1, wherein the raised regions do not project beyond a front surface of the sliding element.

4. The sliding element as claimed in claim 2, wherein the lowered regions are bevels.

5. The sliding element as claimed in claim 2, wherein the lowered regions adjoin the base level of the stop surface in a step-free manner.

6. The sliding element as claimed in claim 1, wherein the stop surface has an at least approximately semicircular portion.

7. The sliding element as claimed in claim 6, wherein two of the raised regions adjoin the semicircular portion of the stop surface.

8. The sliding element as claimed in claim 7, wherein the semicircular portion of the stop surface is inclined relative to a front surface of the sliding element.

9. The sliding element as claimed in claim 1, wherein at least one further elevation is formed on the stop surface.

10. The sliding element as claimed in claim 1, wherein the raised regions are tapered.

11. The sliding element as claimed in claim 1, wherein the individual raised regions are cam-shaped, spherical section-shaped, conical, pyramid-shaped or cylindrical shaped.

12. The sliding element as claimed in claim 1, wherein the sliding element has a cylindrical opening with a central longitudinal axis.

13. A connecting tool for producing a connection between a tube connection element and a widened end portion of a tube, wherein, in the connection, a sliding sleeve is slid onto the widened end portion and at least one end portion of the tube connection element is slid into the widened end portion of the tube, the connecting tool comprising a first sliding element having a stop surface configured for arranging an end surface of the sliding sleeve on and facing the stop surface, and recess configured for the arrangement therein of a portion of the tube, and a second sliding element configured to transmit a sliding force onto the tube connection element, wherein at least the first sliding element is the sliding element as claimed in claim 1.

14. The sliding element as claimed in claim 1, wherein the raised regions are provided on extension portions which extend the stop surface on both sides of the recess beyond an end of a respective limb.

15. A sliding element for transmitting a sliding force onto a sliding sleeve which is provided to be slid, at least in sections, onto a widened end region of a tube, the sliding element comprising at least one stop surface with a recess, wherein the stop surface is configured for arranging an end surface of the sliding sleeve on and facing the stop surface, the recess is configured for the arrangement therein of a portion of the tube, the stop surface has a first edge adjacent the recess and a second edge spaced away from the recess, the stop surface comprises extension portions which extend the stop surface on both sides of the recess beyond an end of a respective limb, and the stop surface of each of the extension portions has one edge adjacent the recess and another edge ending radially inwardly from the second edge.

16. The sliding element as claimed in claim 15, wherein the extension portions do not project beyond a front surface of the sliding element.

17. The sliding element as claimed in claim 15, wherein the stop surface has an at least approximately semicircular portion.

18. The sliding element as claimed in claim 17, wherein the extension portions adjoin the semicircular portion of the stop surface.

19. The sliding element as claimed in claim 18, wherein the semicircular portion of the stop surface is inclined relative to a front surface of the sliding element.

20. The sliding element as claimed in claim 15, wherein at least one further elevation is formed on the stop surface.

21. The sliding element as claimed in claim 15, wherein the extension portions are tapered.

22. The sliding element as claimed in claim 15, wherein the individual extension portions are cam-shaped, spherical section-shaped, conical, pyramid-shaped or cylindrical-shaped.

23. The sliding element as claimed in claim 15, wherein the sliding element has a cylindrical opening with a central longitudinal axis.

24. A connecting tool for producing a connection between a tube connection element and a widened end portion of a tube, wherein, in the connection, a sliding sleeve is slid onto the widened end portion and at least one end portion of the tube connection element is slid into the widened end portion of the tube, the connecting tool comprising a first sliding element having a stop surface configured for arranging an end surface of the sliding sleeve on and facing the stop surface, and recess configured for the arrangement therein of a portion of the tube, and a second sliding element configured to transmit a sliding force onto the tube connection element, wherein at least the first sliding element is the sliding element as claimed in claim 15.

* * * * *